US008684866B2

(12) United States Patent
Sullivan et al.

(10) Patent No.: US 8,684,866 B2
(45) Date of Patent: Apr. 1, 2014

(54) GOLF BALLS HAVING LOW AND HIGH MODULUS CORE LAYERS BASED ON POLYALKENAMER RUBBER

(75) Inventors: Michael J. Sullivan, Barrington, RI (US); Brian Comeau, Berkley, MA (US); Mark L. Binette, Mattapoisett, MA (US); David A. Bulpett, Boston, MA (US); Douglas S. Goguen, New Bedford, MA (US); Robert Blink, Newport, RI (US)

(73) Assignee: Acushnet Company, Fairhven, MA (US)

( * ) Notice: Subject to any disclaimer, the term of this patent is extended or adjusted under 35 U.S.C. 154(b) by 283 days.

(21) Appl. No.: 12/870,914

(22) Filed: Aug. 30, 2010

(65) Prior Publication Data

US 2012/0052984 A1 Mar. 1, 2012

(51) Int. Cl.
*A63B 37/04* (2006.01)

(52) U.S. Cl.
USPC ..... 473/374; 473/371; 473/376; 525/75

(58) Field of Classification Search
None
See application file for complete search history.

(56) References Cited

U.S. PATENT DOCUMENTS

| | | | | |
|---|---|---|---|---|
| 3,492,245 | A | 1/1970 | Calderon et al. | |
| 3,804,803 | A | 4/1974 | Streck et al. | |
| 4,183,876 | A | 1/1980 | Coran et al. | |
| 4,792,141 | A | 12/1988 | Llort | |
| 4,840,993 | A | 6/1989 | Bartz | |
| 5,460,367 | A * | 10/1995 | Horiuchi | 473/604 |
| 6,767,940 | B2 | 7/2004 | Voorheis et al. | |
| 6,783,468 | B2 | 8/2004 | Sullivan et al. | |
| 6,981,926 | B2 | 1/2006 | Sullivan et al. | |
| 6,988,962 | B2 | 1/2006 | Sullivan et al. | |
| 7,041,009 | B2 | 5/2006 | Sullivan et al. | |
| 7,044,864 | B2 | 5/2006 | Sullivan et al. | |
| 7,118,495 | B2 | 10/2006 | Sullivan et al. | |
| 7,125,345 | B2 | 10/2006 | Sullivan et al. | |
| 7,207,903 | B2 | 4/2007 | Sullivan et al. | |
| 7,211,008 | B2 | 5/2007 | Sullivan et al. | |
| 7,357,736 | B2 | 4/2008 | Sullivan et al. | |
| 7,452,290 | B2 | 11/2008 | Sullivan et al. | |
| 7,513,838 | B2 | 4/2009 | Sullivan et al. | |
| 7,528,196 | B2 | 5/2009 | Kim et al. | |
| 7,530,907 | B2 | 5/2009 | Sullivan et al. | |
| 7,654,916 | B2 | 2/2010 | Sullivan et al. | |
| 7,654,917 | B2 | 2/2010 | Sullivan et al. | |
| 2004/0082407 | A1 * | 4/2004 | Sullivan et al. | 473/371 |

(Continued)

OTHER PUBLICATIONS

Evonik Industries, Product Information Vestenamer 8012 rubber with unique properties, Mar. 2009.

*Primary Examiner* — Gene Kim
*Assistant Examiner* — John E Simms, Jr.
(74) *Attorney, Agent, or Firm* — Daniel W. Sullivan

(57) ABSTRACT

Golf balls golf balls containing a core having at least two layers made from a polyalkenamer rubber composition are provided. At least one layer is made from a relatively low modulus polyalkenamer rubber composition and at least one layer is made from a relatively high modulus polyalkenamer rubber composition. The rubber composition may further include other rubbers such as, for example, polybutadiene, polyisoprene, ethylene propylene rubber, ethylene propylene diene rubber, and styrene-butadiene rubber. The rubber composition helps improve resiliency of the core. In one version, a dual-core having an inner core and surrounding outer core layer is provided. In another version, the golf ball contains a three-piece core having an intermediate core layer made of polybutadiene rubber.

11 Claims, 2 Drawing Sheets

(56) References Cited

U.S. PATENT DOCUMENTS

| | | | | |
|---|---|---|---|---|
| 2006/0047081 | A1* | 3/2006 | Ladd et al. | 525/261 |
| 2006/0252577 | A1* | 11/2006 | Sullivan et al. | 473/354 |
| 2008/0161132 | A1* | 7/2008 | Sullivan et al. | 473/376 |
| 2008/0161133 | A1 | 7/2008 | Sullivan et al. | |
| 2008/0227568 | A1 | 9/2008 | Sullivan et al. | |
| 2009/0011864 | A1* | 1/2009 | Ladd et al. | 473/376 |
| 2009/0042669 | A1* | 2/2009 | Sullivan et al. | 473/373 |
| 2009/0191981 | A1* | 7/2009 | Kim et al. | 473/373 |

* cited by examiner

GOLF BALLS HAVING LOW AND HIGH MODULUS CORE LAYERS BASED ON POLYALKENAMER RUBBER

BACKGROUND OF THE INVENTION

1. Field of the Invention

The present invention is directed to golf balls comprising a core and a cover, wherein the core includes a layer made from a relatively low modulus composition and a layer made from a relatively high modulus composition. Preferably, the core layers are made of a rubber composition comprising cylcoalkene (polyalkenamer) rubber and more preferably polyoctenamer rubber. In one embodiment, the golf ball contains a dual-core, wherein the inner core layer is made of a low modulus polyalkenamer rubber and the outer core layer is made of a high modulus polyalkenamer rubber. In a second embodiment, the inner core layer is made of a high modulus polyalkenamer rubber and the outer core layer is made of a low modulus polyalkenamer rubber.

2. Brief Review of the Related Art

Multi-piece solid golf balls comprising different materials are popular today for several reasons including new manufacturing techniques; availability and cost of raw materials; and playing performance properties. For example, three-piece solid golf balls having an inner core, intermediate layer (inner cover), and outer cover can be made. Typically, the inner core is made of natural or synthetic rubbers such as polybutadiene, polyisoprene, styrene-butadiene, or highly neutralized acid copolymers. Often, the intermediate layer is made of an olefin-based ionomer resin that imparts some hardness to the ball. These ionomer acid copolymers contain inter-chain ionic bonding and are generally made of an α-olefin such as ethylene and a vinyl comonomer having an acid group such as methacrylic, acrylic acid, or maleic acid. Metal ions such as sodium, lithium, zinc, and magnesium are used to neutralize the acid groups in the copolymer. Ionomer resins are available in various grades and identified based on the type of base resin, molecular weight, and type of metal ion, amount of acid, degree of neutralization, additives, and other properties. Finally, the outer cover of conventional golf balls is made from a variety of materials including ionomers, polyamides, polyesters, polyurethanes, and polyureas.

Manufacturers consider various properties when designing and developing golf balls for recreational and professional golfers. The flexural modulus of materials used to make golf balls is an important property. The resiliency and rebounding performance of the golf ball are based primarily on the core of the ball. The core acts as the engine for the ball. Hard materials having a relatively high flexural modulus can be used to make a harder core. The harder core helps impart a higher initial velocity to the golf ball so it travels a greater distance. This is particularly desirable for driver shots off the tee. However, one disadvantage with these harder balls is they tend to provide the player with a rougher and harder "feel." The player may experience a more unnatural feeling when he/she strikes the ball with the club face. Moreover, the player tends to have less control when hitting relatively hard balls. It is more difficult to hit such hard balls with the proper touch and spin. This is particularly troublesome when making approach shots with irons.

The golf ball industry is constantly looking to develop compositions that can be used to make multi-piece golf balls having good distance and playability. For example, Kim et al., U.S. Pat. No. 7,528,196 and U.S. Patent Application Publication US 2009/0191981 disclose a golf ball comprising a core, cover layer, and optionally one or more inner cover layers, wherein at least one portion of the ball comprises a blend of a polyalkenamer and polyamide. The polyalkenamer/polyamide composition contains about 2 to about 90 weight % of a polyalkenamer polymer and about 10 to about 98 weight % of a polyamide. The '196 patent and '981 Published Application further disclose that the polyalkenamer/polyamide composition may be blended with other polymers including polybutadiene, polyisoprene, polychloroprene, polybutylene, and styrene-butadiene rubber prior to molding. However, neither the '196 patent nor '981 Published Application discloses a golf ball containing at least one layer made from a relatively low modulus polyalkenamer rubber composition and at least one layer made from a relatively high modulus polyalkenamer.

In Voorheis et al., U.S. Pat. No. 6,767,940, a golf ball having a core, an intermediate layer, and a cover is disclosed. The core is formed from a composition containing an elastomeric polymer, free-radical initiator, and at least one stable free-radical. The stable free-radical increases the scorch time (time between start of reaction and onset of cross-linking) of the elastomeric polymer. The '940 patent discloses numerous materials that can be used to form the intermediate layer, which is distinguishable from the core, including natural rubbers; balata; gutta-percha; cis-polybutadienes; trans-polybutadienes; synthetic polyisoprenes; polyoctenamers; polypropylene resins; ionomer resins; polyamides; polyesters; urethanes; polyureas; chlorinated polyethylenes; polysulfide rubbers; and fluorocarbons.

In Sullivan et al., U.S. Pat. Nos. 6,783,468, 7041,009, 7,044,864, 7,118,495, and 7,125,345, a golf ball having a low compression and high coefficient of restitution (COR) layer supported and reinforced by a low deformation layer is disclosed. The preferred polymeric composition for the high COR layer is a base rubber compound, a co-reaction agent, a halogenated organosulfur compound, and a co-cross-linking or initiator agent. The low deformation layer may be made of rigid plastics or polymers reinforced with high strength organic or inorganic fillers or fibers. In one embodiment, the golf ball comprises an innermost core, an outer core, and a cover. The inner core comprises a low deformation material and the outer core comprises a rubber composition. The patents disclose that natural rubbers, including cis-polyisoprene, trans-polyisoprene or balata, synthetic rubbers including 1,2-polybutadiene, cis-polybutadiene, trans-polybutadiene, polychloroprene, poly(norbornene), polyoctenamer and polypentenamer may be used for the outer core. However, there is no disclosure of golf balls containing at least one layer made from a relatively low modulus polyalkenamer rubber composition and at least one layer made from a relatively high modulus polyalkenamer.

In addition, Llort, U.S. Pat. No. 4,792,141 describes a balata-covered golf ball, where up to 40% of the balata used to faun the cover has been replaced with polyoctenylene rubber. The golf ball contains a core and a cover wherein the cover is formed from a composition comprising about 97 to about 60 parts balata and about 3 to about 40 parts by weight polyoctenylene rubber based on 100 parts by weight polymer in the composition. The '141 patent discloses that using more than about 40 parts by weight of polyoctenylene produces deleterious effects.

One objective of the present invention is to develop compositions that can be used to make a core for a golf ball, wherein the core provides the ball with high resiliency along with a comfortable and soft feel. The present invention provides golf ball core compositions having such properties as well as other advantageous characteristics, features, and benefits.

SUMMARY OF THE INVENTION

The present invention is directed to golf balls containing a core having at least two layers made from a cycloalkene (polyalkenamer) rubber composition. The polyalkenamer rubber has a trans-content of 55% or greater and a melting point of 30° C. or greater and is present in an amount of at least 50 weight percent. The concentration of polyalkenamer rubber is preferably in the range of about 60 to about 100 weight percent based on total weight of polymer. The rubber composition may further include other rubbers such as, for example, polybutadiene, polyisoprene, ethylene propylene rubber, ethylene propylene diene rubber, and styrene-butadiene rubber. The rubber composition helps improve core resiliency.

More particularly, at least one layer is made from a relatively low modulus polyalkenamer rubber composition and at least one layer is made from a relatively high modulus polyalkenamer rubber composition. The low modulus rubber material preferably has a modulus in the range of 1,000 to 50,000 psi, while the high modulus rubber material preferably has a modulus in the range of 25,000 to 150,000 psi. In one embodiment, the first rubber composition has a modulus that is at least 10%, and more preferably 25%, less than the modulus of the second rubber composition. The dual-core preferably has an overall compression in the range of 70 to 90, and an overall diameter in the range of 1.52 to 1.59 inches.

In one embodiment, the inner core has a surface hardness in the range of 30 to 87 Shore C, preferably 65 to 85 Shore C. In one embodiment, the outer core has a surface hardness in the range of 80 to 97 Shore C and preferably 85 to 93 Shore C. The cover may be single or multi-layered. In one version, the cover layer is made from a polyurethane, polyurea, or hybrid, copolymer, or blend of polyurethane-polyurea. In one version, the cover comprises inner and outer cover layers. The inner cover can be made of an olefin-based ionomer and the outer cover can be made of a polyurethane or polyurea among other materials. Preferably, the hardness of the inner cover layer is greater than the hardness of the outer cover layer. In another version, the golf ball contains a three-piece core comprising inner core, outer core, and intermediate core layers. The intermediate core layer may be formed from a non-polyalkenamer rubber composition such as polybutadiene rubber.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Figure 1:
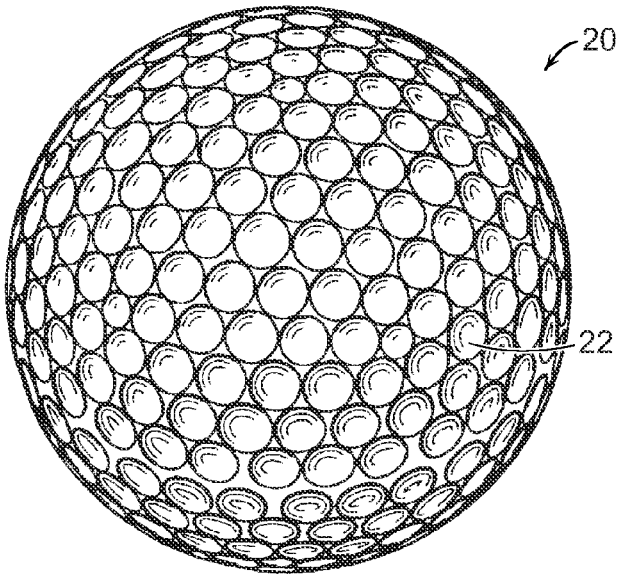
FIG. 1 is a front view of a dimpled golf ball made in accordance with the present invention.

The present invention relates generally to golf balls containing a core having at least two layers made from a rubber composition, wherein the rubber composition comprises a cycloalkene (polyalkenamer) rubber having a trans-content of 55% or greater and a melting point of 30° C. or greater in an amount of at least 50 weight percent, preferably a polyoctenamer. More particularly, at least one layer is made from a relatively low modulus polyalkenamer rubber composition and at least one layer is made from a relatively high modulus polyalkenamer composition.

By the term, "modulus" as used herein, it is meant flexural modulus which is the ratio of stress to strain within the elastic limit (when measured in the flexural mode) and is similar to tensile modulus. This property is used to indicate the bending stiffness of a material. The flexural modulus, which is a modulus of elasticity, is determined by calculating the slope of the linear portion of the stress-strain curve during the bending test. The formula used to calculate the flexural modulus from the recorded load (F) and deflection (D) is:

$$E_B = \frac{3}{4}\frac{FL^3}{bd^3D}$$

wherein

L=span of specimen between supports (m);

b=width (m); and d=thickness (m)

If the slope of the stress-strain curve is relatively steep, the material has a relatively high flexural modulus meaning the material resists deformation. If the slope is relatively flat, the material has a relatively low flexural modulus meaning the material is more easily deformed. Flexural modulus can be determined in accordance with ASTM D790 standard among other testing procedures.

Golf balls having various constructions may be made in accordance with this invention. For example, golf balls having three-piece, four-piece, and five-piece constructions with single or multi-layered cover materials may be made The term, "layer" as used herein means generally any spherical portion of the golf ball. More particularly, in one version, a three-piece golf ball containing a dual-core (inner core and outer core layer) and a single-layered cover is made. In another version, a four-piece golf ball containing a dual-core and a multi-layered cover is made. In yet another construction, a five-piece golf ball having a three-piece core and multi-layered cover is made. The diameter and thickness of the different layers along with properties such as hardness and compression may vary depending upon the construction and desired playing performance properties of the golf ball. The core may contain sections having substantially the same hardness or different hardness levels. That is, there can be substantially uniform hardness throughout the different sections or there can be hardness gradients as discussed in further detail below.

Low Modulus and High Modulus Core Layers

The relatively low modulus polyalkenamer rubber compositions have a modulus and material hardness less than the relatively high modulus polyalkenamer rubber compositions of the present invention. Preferably, the low modulus polyalkenamer rubber compositions have a lower limit of 1,000 or 5,000 or 10,000 psi and an upper limit of 17,000 or 25,000 or 28,000 or 30,000 or 35,000 or 45,000 or 50,000, and a hardness of 30 Shore C or greater, or 40 Shore C or greater, or 50 Shore C or greater, or within a range having a lower limit of 30 or 40 or 50 Shore C and an upper limit of 60 or 70 or 80 or 87 Shore C. On the other hand, high modulus polyalkenamer rubber compositions preferably have a modulus within the range having a lower limit of 25,000 or 27,000 or 30,000 or 40,000 or 45,000 or 50,000 or 55,000 or 60,000 psi and an upper limit of 72,000 or 75,000 or 100,000 or 150,000 and a hardness of 80 Shore C or greater, or 87 Shore C or greater, or 90 Shore C or greater, or within a range having a lower limit of 80 or 87 or 90 Shore C and an upper limit of 90 or 95 or 100 Shore C. In a preferred embodiment, the modulus of the low modulus polyalkeanmer rubber composition is at least 10% less, or at least 20% less, or at least 25% less, or at least 30% less, or at least 35% less, than the modulus of the high modulus polyalkeanmer rubber composition.

In accordance with the present invention, it has been found that polyalkeanmer (also referred to as cylcoalkene) rubber compositions can be used to form the low modulus and high modulus core layers. In one preferred embodiment, a rubber composition comprising "cycloalkene rubber" may be used to make at least one section (center, intermediate, or outer layer) of the core. In accordance with the present invention, it now has been found that rubber compositions comprising "cycloalkene rubber" can be used to provide a golf ball having improved resiliency and rebounding properties along with a soft feel. Cycloalkene rubbers are rubbery polymers made from one or more cycloalkenes having from 5 to 20, preferably 5 to 15, ring carbon atoms. The cycloalkene rubbers (also referred to as polyalkenylene or polyalkenamer rubbers) may be prepared by ring opening metathesis polymerization of one or more cycloalkenes in the presence of organometallic catalysts as is known in the art. Such polymerization methods are disclosed, for example, in U.S. Pat. Nos. 3,492,245 and 3,804,803, the disclosures of which are hereby incorporated by reference. By the term, "cycloalkene rubber" as used herein, it is meant a compound having at least 20 weight % macrocycles (cyclic content). The cyclic and linear portions of the cycloalkene rubber have the following general chemical structures:

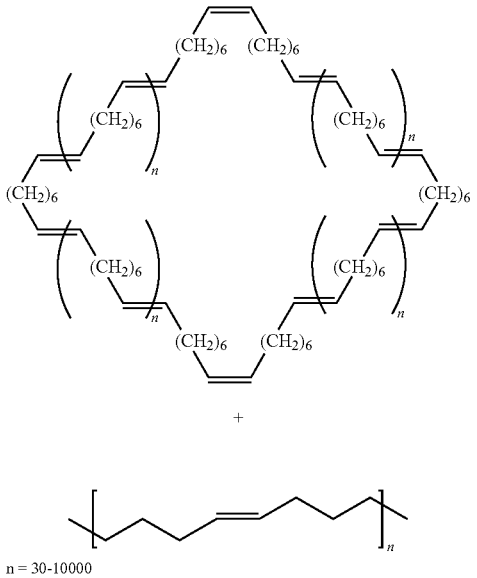

n = 30-10000

Suitable cyclic olefins that can be used to make the cycloalkene rubber include unsaturated hydrocarbons with 4 to 12 ring carbon atoms in one or more rings e.g., 1-3 rings, which exhibit in at least one ring an unsubstituted double bond which is not in conjugation to a second double bond which may be present and which may have any degree of substitution; the substituents must not interfere with the metathesis catalysts and are preferably alkyl groups of 1 to 4 carbon atoms or a part of a cyclic structure of 4 to 8 carbon atoms. Examples are cyclobutene, cyclopentene, cycloheptene, cis- and trans-cyclooctene, cyclononene, cyclodecene, cycloundecene, cis- and trans-cyclododecene, cis, cis-cyclooctadiene, 1-methyl-1,5-cyclooctadiene, 3-methyl-1,5-cyclooctadiene, and 3,7-dimethyl-1,5-cyclooctadiene.

Examples of suitable polyalkenamer rubbers are polypentenamer rubber, polyheptenamer rubber, polyoctenamer rubber, polydecenamer rubber and polydodecenamer rubber. Polyoctenamer rubbers are commercially available from Evonik Degussa GmbH of Marl, Germany and sold under the VESTENAMER tradename. The polyalkenamer rubber used in the present invention preferably has a trans-bond content of about 55% or greater and a second heat melting point of about 30° C. or greater. More preferably, the cycloalkene rubber has a trans-bond content of 75% or greater and a second heat melting point of 50° C. or greater. Furthermore, the polyalkenamer rubber material preferably has a molecular weight of about 80,000 or greater (measured according to GPC); a glass transition temperature (Tg) of about 55° C. or less (measured according to ISO 6721 or 4663); a cis-to-trans ratio of double bonds of about 40:60 or preferably about 20:80 (measured according to IR); a Mooney viscosity ML (1+4) 100° C. of less than about 10 (measured according to DIN 53 523 or ASTM-D 1646); a viscosity number J/23° C. of about 130 or preferably about 120 ml/g (measured according to ISO 1628-1); and a density of about 0.9 g/cm$^3$ or greater (measured according to DIN 53 479 A or ISO 1183).

The polyalkenamer rubber compound, of and by itself, has relatively high crystallinity. For example, a specific grade of polyalkenamer rubber (VESTENAMER 8012) has a crystallinity of approximately 30% (measured by DSC, second melting.) The ratio of cis double bonds to trans double bonds (cis/trans ratio) in the polymer is significant in determining the degree of crystallinity in the polymer. In general, if the trans-bond content of the polymer is relatively high, the crystallinity and melting point of the polymer is relatively high. That is, as the trans-bond content increases, the crystallinity of the polymer increases. The polyalkenamer rubber, VESTENAMER 8012 has a trans-bond content of about 80%. In accordance with the present invention, it has been found the compression of polyalkenamer rubber cores is reduced and the Coefficient of Restitution ("COR") of the cores is increased when the rubber composition is cross-linked to a relatively high degree and the composition does not contain a reactive cross-linking co-agent such as zinc diacrylate (ZDA). The polyalkenamer rubber composition may be cured using a conventional curing process such as peroxide-curing, sulfur-curing, and high-energy radiation, and combinations thereof. For example, the composition may be peroxide-cured. When peroxide is added at relatively high amounts (particularly, at least 2.5 and preferably 5.0 phr) and the composition (which if it does not contain a reactive cross-linking co-agent such as ZDA) is cured to cross-link the rubber chains, then the compression of the polyalkenamer rubber cores is reduced and the COR of the cores is increased. It is believed this phenomenon is due, at least in part, to disrupting the crystalline structure of the polymer by curing and cross-linking the composition in accordance with this invention. While not wishing to be bound by any theory, it is believed the cross-linking causes the tightly packed structures within the mass of polyalkenamer polymer to spread out, thus disrupting the crystallinity of the material. It appears the crystallinity may be partially disrupted and the polymer remains in a partially crystalline state. As a result, the polyalkenamer rubber (which if it does not contain a reactive cross-linking agent such as ZDA) becomes softer and more rubbery and the compression of core samples made from the composition decreases.

One example of a commercially-available material that can be used in accordance with this invention is VESTENAMER 8012 (trans-bond content of about 80% and a melting point of about 54° C.). The material, VESTENAMER 6213 (trans-bond content of about 60% and a melting point of about 30°) also may be effective.

In the present invention, it has been found that rubber compositions comprising polyoctenamer rubber are particularly effective. Polyoctenamer rubber compositions can be used to make a core that provides the golf ball with good rebounding properties (distance) without sacrificing a nice feel to the ball. The resulting ball has a relatively high COR allowing it to reach a high velocity when struck by a golf club. Thus, the ball tends to travel a greater distance which is particularly important for driver shots off the tee. Meanwhile, the soft feel of the ball provides the player with a more pleasant sensation when he/she strikes the ball with the club. The player senses more control over the ball as the club face makes impact. Furthermore, the soft feel of the ball's cover allows players to place a spin on the ball and better control its flight pattern which is particularly important for approach shots near the green.

The polyalkenamer rubber is used in an amount of at least 50% by weight based on total amount of polymer in the rubber composition used to make the core. Preferably, the polyalkenamer rubber is present in an amount of 65 to 100% by weight and more preferably 75 to 100% by weight based on total polymer weight. It is believed that when the concentration of the polyalkenamer rubber is less than 50% by weight, the resiliency of the rubber composition is not significantly improved. In particular versions, the blend may contain a lower concentration of polylakenamer rubber in the amount of 50%, 55%, 60%, 65%, or 70% and an upper concentration of polyalkenamer in the amount of 75%, 80%, 85%, 90%, or 95%.

The polyalkenamer rubber may be blended with other rubber and polymeric materials. As described above, these rubber materials include, but are not limited to, polybutadiene, polyisoprene, ethylene propylene rubber ("EPR"), ethylene propylene diene rubber ("EPDM"), styrene-butadiene rubber, styrenic block copolymer rubbers (such as SI, SIS, SB, SBS, SIBS, SEBS, and the like, where "S" is styrene, "I" is isobutylene, "B" is butadiene, and "E" is ethylene), butyl rubber, halobutyl rubber, polystyrene elastomers, polyethylene elastomers, polyurethane elastomers, polyurea elastomers, metallocene-catalyzed elastomers and plastomers, copolymers of isobutylene and para-alkylstyrene, halogenated copolymers of isobutylene and para-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof. A preferred base rubber is 1,4-polybutadiene having a cis-bond structure of at least 40%, preferably greater than 80%, and more preferably greater than 90%.

Examples of commercially available polybutadiene rubbers that can be used in accordance with this invention include, but are not limited to, BUNA® CB22 and BUNA® CB23, commercially available from Lanxess Corp.; UBEPOL® 360L and UBEPOL® 150L and UBEPOL-BR rubbers, commercially available from UBE Industries, Ltd. of Tokyo, Japan; KINEX® 7245 and KINEX® 7265, commercially available from Goodyear of Akron, Ohio; SE BR-1220, and BUNA® CB1203G1, CB1220, and CB1221, commercially available from Lanxess Corp.; EUROPRENE® NEOCIS® BR 40 and BR 60, commercially available from Polimeri Europa; and BR 01, BR 730, BR 735, BR 11, and BR 51, commercially available from Japan Synthetic Rubber Co., Ltd; and Afdene 45, Afdene 50, Neodene 40, and Neodene 45, commercially available from Karbochem (PTY) Ltd. of Bruma, South Africa.

As discussed above, the polyalkenamer rubber composition may be cured using a conventional curing process. Suitable curing processes include, for example, peroxide-curing, sulfur-curing, high-energy radiation, and combinations thereof. Preferably, the rubber composition contains a free-radical initiator selected from organic peroxides, high energy radiation sources capable of generating free-radicals, and combinations thereof. In one preferred version, the rubber composition is peroxide-cured. Suitable organic peroxides include, but are not limited to, dicumyl peroxide; n-butyl-4,4-di(t-butylperoxy)valerate; 1,1-di(t-butylperoxy)3,3,5-trimethylcyclohexane; 2,5-dimethyl-2,5-di(t-butylperoxy)hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; and combinations thereof. In a particular embodiment, the free radical initiator is dicumyl peroxide, including, but not limited to Perkadox® BC, commercially available from Akzo Nobel. Peroxide free-radical initiators are generally present in the rubber composition in an amount of at least 0.05 parts by weight per 100 parts of the base rubber, or an amount within the range having a lower limit of 0.05 parts or 0.1 parts or 1 part or 1.25 parts or 1.5 parts or 2.5 parts or 5 parts by weight per 100 parts of the total rubbers, and an upper limit of 2.5 parts or 3 parts or 5 parts or 6 parts or 10 parts or 15 parts by weight per 100 parts of the base rubber. In one preferred version, the peroxide free-radical initiator is present in an amount of at least 2.5 and more preferably 5 parts per hundred (phr). As further discussed in the Examples below, it is believed the high crystallinity of the polyalkenamer rubber is reduced by adding the peroxide at relatively high amounts to the rubber composition and curing the composition so it is cross-linked.

The polyalkenamer rubber composition may further include a reactive cross-linking co-agent. Suitable co-agents include, but are not limited to, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. Particular examples of suitable metal salts include, but are not limited to, one or more metal salts of acrylates, diacrylates, methacrylates, and dimethacrylates, wherein the metal is selected from magnesium, calcium, zinc, aluminum, lithium, and nickel. In a particular embodiment, the co-agent is selected from zinc salts of acrylates, diacrylates, methacrylates, and dimethacrylates. In another particular embodiment, the agent is zinc diacrylate (ZDA). When the co-agent is zinc diacrylate and/or zinc dimethacrylate, the co-agent is typically included in the rubber composition in an amount within the range having a lower limit of 1 or 5 or 10 or 15 or 19 or 20 parts by weight per 100 parts of the total rubber, and an upper limit of 24 or 25 or 30 or 35 or 40 or 45 or 50 or 60 parts by weight per 100 parts of the total rubber.

Radical scavengers such as a halogenated organosulfur, organic disulfide, or inorganic disulfide compounds may be added to the polyalkenamer rubber composition to increase the COR at a given compression. Preferred halogenated organosulfur compounds include, but are not limited to, pentachlorothiophenol (PCTP) and salts of PCTP such as zinc pentachlorothiophenol (ZnPCTP). Using PCTP and ZnPCTP in golf ball inner cores helps produce softer and faster inner cores. The PCTP and ZnPCTP compounds help increase the resiliency and the coefficient of restitution of the core. In a particular embodiment, the soft and fast agent is selected from ZnPCTP, PCTP, ditolyl disulfide, diphenyl disulfide, dixylyl disulfide, 2-nitroresorcinol, and combinations thereof.

The polyalkenamer compositions of the present invention also may include "fillers," which are added to adjust the density and/or specific gravity of the material. As used herein, the term "fillers" includes any compound or composition that can be used to adjust the density and/or other properties of the subject golf ball. Suitable fillers include, but are not limited to, polymeric or mineral fillers, metal fillers, metal alloy fillers, metal oxide fillers and carbonaceous fillers. Fillers can be in the form of flakes, fibers, fibrils, or powders. Regrind, which is ground, recycled core material (for example, ground to about 30 mesh particle size), can also be used. The amount and type of fillers utilized are governed by the amount and weight of other ingredients in the golf ball, since a maximum golf ball weight of 45.93 g (1.62 ounces) has been established by the United States Golf Association (USGA). Suitable fillers generally have a specific gravity from about 2 to 20. In one preferred embodiment, the specific gravity can be about 2 to 6.

Suitable polymeric or mineral fillers include, for example, precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates such as calcium carbonate and magnesium carbonate. Suitable metal fillers include titanium, tungsten, aluminum, bismuth, nickel, molybdenum, iron, lead, copper, boron, cobalt, beryllium, zinc, and tin. Suitable metal alloys include steel, brass, bronze, boron carbide whiskers, and tungsten carbide whiskers. Suitable metal oxide fillers include zinc oxide, iron oxide, aluminum oxide, titanium oxide, magnesium oxide, and zirconium oxide. Suitable particulate carbonaceous fillers include graphite, carbon black, cotton flock, natural bitumen, cellulose flock, and leather fiber. Micro balloon fillers such as glass and ceramic, and fly ash fillers can also be used.

As discussed above, the rubber compositions may include antioxidants to prevent the breakdown of the elastomers. In addition, the polyalkenamer rubber compositions may optionally include processing aids such as high molecular weight organic acids and salts thereof. Suitable organic acids are aliphatic organic acids, aromatic organic acids, saturated mono-functional organic acids, unsaturated monofunctional organic acids, multi-unsaturated mono-functional organic acids, and dimerized derivatives thereof. Particular examples of suitable organic acids include, but are not limited to, caproic acid, caprylic acid, capric acid, lauric acid, stearic acid, behenic acid, erucic acid, oleic acid, linoleic acid, myristic acid, benzoic acid, palmitic acid, phenylacetic acid, naphthalenic acid, dimerized derivatives thereof. The organic acids are aliphatic, mono-functional (saturated, unsaturated, or multi-unsaturated) organic acids. Salts of these organic acids may also be employed. The salts of organic acids include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending.)

Other ingredients such as accelerators (for example, tetra methylthiuram), processing aids, dyes and pigments, wetting agents, surfactants, plasticizers, coloring agents, fluorescent agents, chemical blowing and foaming agents, defoaming agents, stabilizers, softening agents, impact modifiers, antioxidants, antiozonants, as well as other additives known in the art may be added to the rubber composition. The core may be formed by mixing and molding the rubber composition using conventional techniques. These cores can be used to make finished golf balls by surrounding the core with outer core layer(s), intermediate layer(s), and cover materials as discussed further below.

Dual-Core/Single-Layered Cover

In one embodiment, the present invention provides a golf ball comprising an inner core layer formed from a low modulus polyalkenamer rubber composition, an outer core layer formed from a high modulus polyalkenamer rubber composition, and a cover having a single layer. In another embodiment, the present invention provides a golf ball comprising an inner core layer formed from a high modulus polyalkenamer rubber composition, an outer core layer formed from a low modulus polyalkenamer rubber composition, and a cover having a single layer Dual-Core/Multi-Layered Cover Golf Balls In another embodiment, the present invention provides a golf ball comprising an inner core layer formed from a low modulus polyalkenamer rubber composition, an outer core layer formed from a high modulus polyalkenamer rubber composition, and a multi-layered cover. In another embodiment, the present invention provides a golf ball comprising an inner core layer formed from a high modulus polyalkenamer rubber composition, an outer core layer formed from a low modulus polyalkenamer rubber composition, and a multi-layered-cover. Preferably, the multi-layered cover includes an inner cover and outer cover material.

Cover Materials

The multi-layered core of this invention may be enclosed with one or two cover layers. Conventional thermoplastic or thermoset resins such as, for example, olefin-based ionomeric copolymers, polyamides, polyesters, polycarbonates, polyolefins, polyurethanes, and polyureas as described above can be used to make the inner and outer cover layers.

Ionomer-based compositions, particularly olefin-based ionomers, are known to be useful as a golf ball cover material, particularly as an inner cover layer, because they can impart desirable hardness to the ball. Olefin-based ionomers are acid copolymers that normally include α-olefin, such as ethylene and an α,β-ethylenically unsaturated carboxylic acid having 3 to 8 carbons, such as methacrylic acid or acrylic acid. Other possible carboxylic acid groups include, for example, crotonic, maleic, fumaric, and itaconic acid. The acid copolymers may optionally contain a softening monomer such as alkyl acrylate and alkyl methacrylate, wherein the alkyl groups have from 1 to 8 acarbon atoms. "Low acid" and "high acid" olefin-based ionomers, as well as blends of such ionomers, may be used. In general, low acid ionomers are considered to be those containing 16 wt. % or less of carboxylic acid, whereas high acid ionomers are considered to be those containing greater than 16 wt. % of carboxylic acid. The acidic group in the olefin-based ionic copolymer is partially or totally neutralized with metal ions such as zinc, sodium, lithium, magnesium, potassium, calcium, manganese, nickel, chromium, copper, or a combination thereof. For example, ionomeric resins having carboxylic acid groups that are neutralized from about 10 percent to about 100 percent may be used. In one embodiment, the acid groups are partially neutralized. That is, the neutralization level is from 10 to 80%, more preferably 20 to 70%, and most preferably 30 to 50%. In another embodiment, the acid groups are highly or fully neutralized. That is, the neutralization level is from 80 to 100%, more preferably 90 to 100%, and most preferably 95 to 100%.

Ionomeric compositions can be blended with non-ionic thermoplastic resins, particularly to manipulate product properties. Examples of suitable non-ionic thermoplastic resins include, but are not limited to, polyurethane, poly-ether-ester, poly-amide-ether, polyether-urea, Pebax® thermoplastic polyether block amides commercially available from Arkema Inc., styrene-butadiene-styrene block copolymers, styrene (ethylene-butylene)-styrene block copolymers, polyamides, polyesters, polyolefins (e.g., polyethylene, polypropylene, ethylene-propylene copolymers, ethylene-(meth)acrylate, ethylene-(meth)acrylic acid, functionalized polymers with maleic anhydride grafting, Fusabond® functionalized olefins commercially available from E. I. du Pont de Nemours and Company, functionalized polymers with epoxidation, elastomers (e.g., EPDM, metallocene-catalyzed polyethylene) and ground powders of the thermoset elastomers. The inner cover layer material may include a flow modifier, such as, but not limited to, Nucrel® acid copolymer resins, and particularly Nucrel® 960. Nucrel® acid copolymer resins are commercially available from E. I. du Pont de Nemours and Company.

The outer cover layer is preferably formed from a composition comprising polyurethane; polyurea; or a blend, copolymer, or hybrid of polyurethane/polyurea. The outer cover layer material may be thermoplastic or thermoset. Basically, polyurethane compositions contain urethane linkages fainted by reacting an isocyanate group (—N═C═O) with a hydroxyl group (OH). Polyurethanes are produced by the reaction of a multi-functional isocyanate with a polyol in the presence of a catalyst and other additives. The chain length of the polyurethane prepolymer is extended by reacting it with a hydroxyl-terminated curing agent. Polyurea compositions, which are distinct from the above-described polyurethanes, also can be formed. In general, polyurea compositions contain urea linkages formed by reacting an isocyanate group (—N═C═O) with an amine group (NH or $NH_2$). The chain length of the polyurea prepolymer is extended by reacting the prepolymer with an amine curing agent. Hybrid compositions containing urethane and urea linkages also may be produced. For example, a polyurethane/urea hybrid composition may be produced when a polyurethane prepolymer is reacted with an amine-terminated curing agent. The term, "hybrid polyurethane-polyureas" is also meant to encompass blends and copolymers of polyurethanes and polyureas.

In one embodiment, a multi-layered cover comprising inner and outer cover layers is formed, where the inner cover layer has a thickness of about 0.01 inches to about 0.06 inches, more preferably about 0.015 inches to about 0.040 inches, and most preferably about 0.02 inches to about 0.035 inches. In this version, the inner cover layer is formed from a partially- or fully-neutralized ionomer having a Shore D hardness of greater than about 55, more preferably greater than about 60, and most preferably greater than about 65. The outer cover layer, in this embodiment, preferably has a thickness of about 0.015 inches to about 0.055 inches, more preferably about 0.02 inches to about 0.04 inches, and most preferably about 0.025 inches to about 0.035 inches, with a hardness of about Shore D 60 or less, more preferably 55 or less, and most preferably about 52 or less. The inner cover layer is harder than the outer cover layer in this version.

A preferred outer cover layer is a castable or reaction injection molded polyurethane, polyurea or copolymer, blend, or hybrid thereof having a Shore D hardness of about 40 to about 50. A preferred inner cover layer material is a partially-neutralized ionomer comprising zinc, sodium or lithium neutralized ionomer such as SURLYN 8940, 8945, 9910, 7930, 7940, or blend thereof having a Shore D hardness of about 63 to about 68. In another multi-layer cover, the outer cover and inner cover layer materials and thickness are the same but, the hardness range is reversed, that is, the outer cover layer is harder than the inner cover layer.

Multi-Layered Cores Containing Non-Polyalkenamer Rubber-Based Layers

As discussed above, multi-layered cores containing at least one low modulus polyalkenamer rubber-based layer and at least one high modulus polyalkenamer rubber-based layer are made in accordance with the present invention. In some instances, it may be desirable for the core to further include a non-polyalkenamer rubber based layer. As described above, suitable non-polyalkenamer rubbers include, but are not limited to, polyisoprene; balata; polybutadiene such as, for example, 1,2-polybutadiene, 1,4-polybutadiene, cis-polybutadiene, and trans-polybutadiene; ethylene propylene rubber ("EPR"); ethylene propylene diene rubber ("EPDM"); styrene-butadiene rubber ("SBR"); styrenic block copolymer rubbers (such as SI, SIS, SB, SBS, SIBS, and the like, where "S" is styrene, "I" is isobutylene, and "B" is butadiene); butyl rubber; halobutyl rubber; polystyrene elastomers; polyethylene elastomers; polyurethane elastomers; polyurea elastomers; metallocene-catalyzed elastomers and plastomers; copolymers of isobutylene and para-alkylstyrene; halogenated copolymers of isobutylene and para-alkylstyrene; copolymers of butadiene with acrylonitrile; polychloroprene; polynorbornene; alkyl acrylate rubber; chlorinated isoprene rubber; acrylonitrile chlorinated isoprene rubber; and combinations of two or more thereof. A preferred base rubber is 1,4-polybutadiene having a cis-bond structure of at least 40%, preferably greater than 80%, and more preferably greater than 90%. Diene rubbers are preferred.

Thus, in one embodiment, the invention provides a golf ball containing a three-piece core comprising: (a) an inner core layer (center) formed from a non-polyalkenamer rubber composition; (b) an intermediate core layer formed from a low modulus polyalkenamer rubber composition; (c) an outer core layer formed from a high modulus polyalkenamer rubber composition; and (d) a cover having one or more layers.

In the above embodiments, the inner core layer preferably has a diameter within the range having a lower limit of 0.500 or 0.750 or 1.000 inches and an upper limit of 1.550 or 1.570 or 1.580 inches; the intermediate core layer preferably has a thickness within the range having a lower limit of 0.020 or 0.025 or 0.032 inches and an upper limit of 0.150 or 0.220 or 0.280 inches; the outer core preferably has a thickness within the range having a lower limit of 0.020 or 0.025 or 0.032 inches and an upper limit of 0.310 or 0.440 or 0.560 inches; and the cover preferably has an overall thickness within the range having a lower limit of 0.020 or 0.025 or 0.030 inches and an upper limit of 0.065 or 0.080 or 0.090 inches. In one particular version, the inner core layer has an Atti compression of 80 or less, or 70 or less, or 65 or less. In yet another version, the inner core layer has an Atti compression of a lower limit of 80 or 90 or 100 and an upper limit of 130 or 140.

In a second embodiment, the present invention provides a golf ball containing a three-piece core comprising: (a) an inner core layer (center) formed from a low modulus polyalkenamer rubber composition; (b) an intermediate core layer formed from a non-polyalkenamer rubber composition; (c) an outer core layer formed from a high modulus polyalkenamer rubber composition; and (d) a cover having one or more layers.

In a third embodiment, the present invention provides a golf ball containing a three-piece core comprising: (a) an inner core layer (center) formed from a low modulus polyalkenamer rubber composition; (b) an intermediate core layer formed from a high modulus polyalkenamer rubber composition; (c) an outer core layer formed from a non-polyalkenamer rubber composition; and (d) a cover having one or more layers.

In a fourth embodiment, the present invention provides a golf ball containing a three-piece core comprising: (a) an inner core layer formed from a non-polyalkenamer rubber composition; (b) an intermediate core layer formed from a high modulus polyalkenamer rubber composition; (c) an outer core layer formed from a low modulus polyalkenamer rubber composition; and (d) a cover having one or more layers.

In a fifth embodiment, the present invention provides a golf ball containing a three-piece core comprising: (a) an inner core layer formed from a high modulus polyalkenamer rubber composition; (b) an intermediate core layer formed from a low modulus polyalkenamer rubber composition; (c) an outer core layer faulted from a non-polyalkenamer rubber composition; and (d) a cover having one or more layers.

In a sixth embodiment, the present invention provides a golf ball containing a three-piece core comprising: (a) an inner core layer formed from a high modulus polyalkenamer rubber composition; (b) an intermediate core layer formed from a non-polyalkenamer rubber composition; (c) an outer core layer formed from a low modulus polyalkenamer rubber composition, and (d) a cover having one or more layers.

It should be understood that the above embodiments are provided for illustrative purposes only and are not meant to be restrictive. Other embodiments of golf balls containing multi-layered cores can be made in accordance with the present invention. For example, in yet another embodiment, a golf ball containing a four-piece core is provided. The golf ball comprises: (a) an inner core layer formed from a first non-polyalkenamer rubber composition; (b) a first intermediate core layer foamed from a low modulus polyalkenamer rubber composition; (c) a second intermediate core layer formed from a second non-polyalkenamer rubber composition; (d) an outer core layer formed from a high modulus polyalkenamer rubber composition; and (e) a cover having one or more layers.

Similar to polyalkenamer rubber materials discussed above, the non-polyalkenamer rubber composition typically contains a cross-linking agent, a filler, a co-crosslinking agent or free radical initiator, and optionally a soft and fast agent.

The cross-linking agent typically includes a metal salt, such as a zinc-, aluminum-, sodium-, lithium-, nickel-, calcium-, or magnesium-salt, of an unsaturated fatty acid or monocarboxylic acid, such as (meth) acrylic acid. Preferred cross-linking agents include zinc acrylate, zinc diacrylate (ZDA), zinc methacrylate, and zinc dimethacrylate (ZDMA), and mixtures thereof. The crosslinking agent must be present in an amount sufficient to crosslink a portion of the chains of the polymers in the resilient polymer component.

The rubber composition optionally contains one or more antioxidants. Antioxidants are compounds that can inhibit or prevent the oxidative degradation of the rubber. Some antioxidants also act as free radical scavengers; thus, when antioxidants are included in the rubber composition, the amount of initiator agent used may be as high or higher than the amounts disclosed herein. Suitable antioxidants include, for example, dihydroquinoline antioxidants, amine type antioxidants, and phenolic type antioxidants.

The rubber composition may also contain one or more fillers to adjust the density and/or specific gravity of the core or cover. Fillers are typically polymeric or mineral particles. Exemplary fillers include precipitated hydrated silica, clay, talc, asbestos, glass fibers, aramid fibers, mica, calcium metasilicate, zinc sulfate, barium sulfate, zinc sulfide, lithopone, silicates, silicon carbide, diatomaceous earth, polyvinyl chloride, carbonates (e.g., calcium carbonate, zinc carbonate, barium carbonate, and magnesium carbonate), metals (e.g., titanium, tungsten, aluminum, bismuth, nickel, molybdenum, iron, lead, copper, boron, cobalt, beryllium, zinc, and tin), metal alloys (e.g., steel, brass, bronze, boron carbide whiskers, and tungsten carbide whiskers), oxides (e.g., zinc oxide, tin oxide, iron oxide, calcium oxide, aluminum oxide, titanium dioxide, magnesium oxide, and zirconium oxide), particulate carbonaceous materials (e.g., graphite, carbon black, cotton flock, natural bitumen, cellulose flock, and leather fiber), microballoons (e.g., glass and ceramic), fly ash, regrind (i.e., core material that is ground and recycled), nanofillers and combinations thereof. The rubber composition may also contain one or more additives selected from processing aids, processing oils, plasticizers, coloring agents, fluorescent agents, chemical blowing and foaming agents, defoaming agents, stabilizers, softening agents, impact modifiers, free radical scavengers, accelerators, scorch retarders, and the like.

The rubber composition optionally includes a soft and fast agent. Suitable soft and fast agents include, but are not limited to, organosulfur or metal-containing organosulfur compounds, an organic sulfur compound, including mono, di, and polysulfides, a thiol, or mercapto compound, an inorganic sulfide compound, a Group VIA compound, a substituted or unsubstituted aromatic organic compound that does not contain sulfur or metal, an aromatic organometallic compound, or mixtures thereof. The soft and fast agent component may also be a blend of an organosulfur compound and an inorganic sulfide compound. Other suitable soft and fast agents include, but are not limited to, hydroquinones, benzoquinones, quinhydrones, catechols, and resorcinols. Preferably, the halogenated thiophenol compound is pentachlorothiophenol, which is commercially available in neat form or under the tradename STRUKTOL®, a clay-based carrier containing the sulfur compound pentachlorothiophenol loaded at 45 percent (correlating to 2.4 parts PCTP). STRUKTOL® is commercially available from Struktol Company of America of Stow, Ohio. PCTP is commercially available in neat form from eChinachem of San Francisco, Calif. and in the salt form from eChinachem of San Francisco, Calif. Most preferably, the halogenated thiophenol compound is the zinc salt of pentachlorothiophenol, which is commercially available from eChinachem of San Francisco, Calif.

In addition to the materials disclosed above, any of the core or cover layers may comprise one or more of the following materials: thermoplastic elastomers, thermoset elastomers, natural and synthetic rubber, copolymeric and terpolymeric ionomers, polycarbonate, polyolefin, polyamide, copolymeric polyamide, polyesters, polyester-amides, polyether-amides, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, metallocene-catalyzed polymers, cellulose polymer, liquid crystal polymer (LCP), ethylene-vinyl acetate copolymer (EVA), ethylene vinyl acetate, polysiloxanes, and highly neutralized polymers (HNPs).

HNPs are salts of acid copolymers. It is understood that the high modulus HNP may be a blend of two or more high modulus HNPs. Preferred acid copolymers are copolymers of an .alpha.-olefin and a $C_3$ to $C_8$ $\alpha,\beta$-ethylenically unsaturated carboxylic acid. The acid is typically present in the acid copolymer in an amount within the range having a lower limit of 1 or 10 or 12 or 15 or 20 wt % and an upper limit of 25 or 30 or 35 or 40 wt %, based on the total weight of the acid copolymer. The $\alpha$-olefin is preferably selected from ethylene and propylene. The acid is preferably selected from (meth) acrylic acid, ethacrylic acid, maleic acid, crotonic acid, fumaric acid, and itaconic acid. (Meth) acrylic acid is particularly preferred. Suitable acid copolymers include partially neutralized acid polymers. The HNP may be formed by reacting an acid copolymer with a sufficient amount of cation source such that at least 80%, preferably at least; 90%, more preferably at least 95%, and even more preferably 100%, of all acid groups present are neutralized. Suitable cation sources include metal ions and compounds of alkali metals, alkaline earth metals, and transition metals; metal ions and compounds of rare earth elements; silicone, silane, and silicate derivatives and complex ligands; and combinations thereof. Preferred cation sources are metal ions and compounds of magnesium, sodium, potassium, cesium, calcium, barium, manganese, copper, zinc, tin, lithium, and rare earth metals. Metal ions and compounds of calcium and magnesium are particularly preferred.

Hardness Gradients

As discussed above, in one preferred embodiment, the dual-core contains an inner core made from a low modulus polyalkenamer rubber composition and a surrounding outer core layer made from a high modulus polyalkenamer rubber composition. In a second preferred embodiment, the dual core contains an inner core made from a high modulus polyalkenamer rubber composition and an outer core layer made from a low modulus polyalkenamer rubber composition. In both instances, the inner core may have a "positive" hardness gradient and the outer core layer has a "negative" hardness gradient (that is, the outer surface of the outer core layer is softer than the inner surface of the outer core layer.)

Other embodiments of golf balls having various combinations of positive, negative, and zero hardness gradients may be made in accordance with this invention. For example, the inner core may have a positive hardness gradient and the outer core layer also may have a positive hardness gradient. In another example, the inner core may have a positive hardness gradient and the outer core layer may have a "zero" hardness gradient. (That is, the hardness values of the outer surface of the outer core layer and the inner surface of the outer core layer are substantially the same.) Particularly, the term, "zero hardness gradient" as used herein, means a surface to center Shore C hardness gradient of less than 8, preferably less than 5 and most preferably less than 3 and may have a value of zero or negative 1 to negative 25. The term, "negative hardness gradient" as used herein, means a surface to center Shore C hardness gradient of less than zero. The terms, zero hardness gradient and negative hardness gradient, may be used herein interchangeably to refer to hardness gradients of negative 1 to negative 25. The term, "positive hardness gradient" as used herein, means a surface to center Shore C hardness gradient of 8 or greater, preferably 10 or greater, and most preferably 20 or greater. By the term, "steep positive hardness gradient" as used herein, it is meant surface to center Shore C hardness gradient of 20 or greater, more preferably 25 or greater, and most preferably 30 or greater. For example, the core may have a step positive hardness gradient of 35, 40, or 45 Shore C or greater. Methods for measuring the hardness of the inner core and surrounding layers and determining the hardness gradients are discussed in further detail below.

More particularly, the inner core (center) preferably has a geometric center hardness of 50 Shore C or greater, or 55 Shore C or greater, or 60 Shore C or greater, or within a range having a lower limit of 50 or 55 or 60 Shore C and an upper limit of 65 or 70 or 80 Shore C. The inner core preferably has a surface hardness of 65 Shore C or greater, or 70 Shore C or greater, or within a range having a lower limit of 55 or 60 or 65 or 70 Shore C or 75 Shore C and an upper limit of 80 or 85 Shore C. Meanwhile, the outer core layer preferably has an outer surface hardness of 75 Shore C or greater, or 80 Shore C or greater, or 85 Shore C or greater, or 87 Shore C or greater, or 89 Shore C or greater, or 90 Shore C or greater, or within a range having a lower limit of 75 or 80 or 85 Shore C and an upper limit of 90 or 95 Shore C. And, the inner surface of the outer core preferably has a surface hardness of 65 Shore C or greater, or 70 Shore C or greater, or within a range having a lower limit of 55 or 60 or 65 or 70 Shore C or 75 Shore C and an upper limit of 80 or 85 Shore C.

The present invention is not limited by any particular process for forming the golf ball layer(s). It should be understood that the layer(s) can be formed by any suitable technique, including injection molding, compression molding, casting, and reaction injection molding. Coefficient of restitution (COR) and Compression are important properties of the golf balls of this invention as discussed further below. The golf balls typically have a COR of 0.70 or greater, preferably 0.75 or greater, and more preferably 0.78 or greater and a Compression of 40 or greater, or a Compression within a range having a lower limit of 50 or 60 and an upper limit of 100 or 120, preferably 90 to 100. Methods for measuring COR and Compression are described in the test methods below.

In one embodiment of a dual-core golf ball, the inner core layer preferably has a compression of 20 or less. The cores of the present invention preferably have an overall compression within a range having a lower limit of 40 or 50 or 60 or 65 or 70 or 75 and an upper limit of 80 or 85 or 90 or 100 or 110 or 120, or an overall compression of about 90. In addition, the golf balls typically will have dimple coverage of 60% or greater, preferably 65% or greater, and more preferably 75% or greater. Furthermore, the golf balls preferably have a Moment of Inertia ("MOI") of 70-95 $g\cdot cm^2$, preferably 75-93 $g\cdot cm^2$, and more preferably 76-90 $g\cdot cm^2$. For low MOI embodiments, the golf ball preferably has an MOI of 85 $g\text{-}cm^2$ or less, or 83 $g\cdot cm^2$ or less. For high MOI embodiments, the golf ball preferably has an MOI of 86 $g\cdot cm^2$ or greater, or 87 g·cm or greater. Methods for measuring MOI are described in farther detail below.

The United States Golf Association specifications limit the minimum size of a competition golf ball to 1.680 inches. There is no specification as to the maximum diameter, and golf balls of any size can be used for recreational play. Golf balls of the present invention can have an overall diameter of any size. The preferred diameter of the present golf balls is from 1.680 inches to 1.800 inches. More preferably, the present golf balls have an overall diameter of from 1.680 inches to 1.760 inches and even more preferably from 1.680 inches to 1.740 inches.

Figure 2:
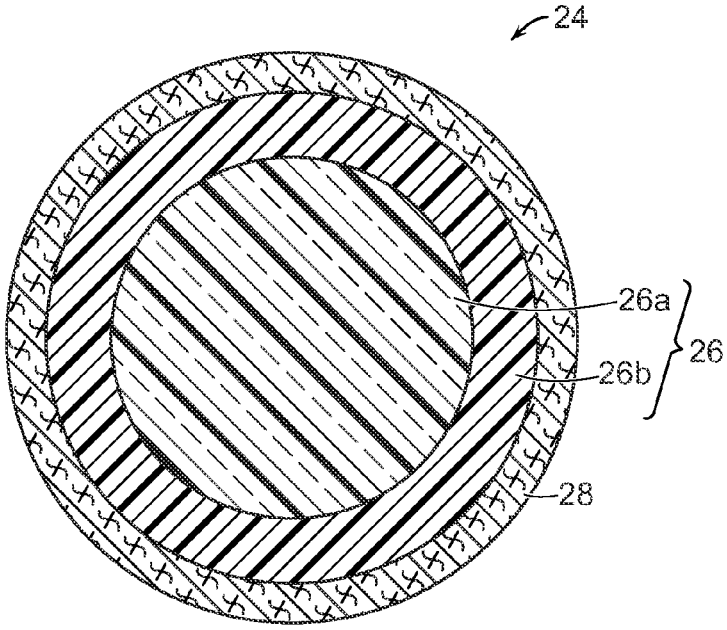
FIG. 2 is a cross-sectional view of a three-piece golf ball having a dual-core comprising inner core and outer core layers made of polyalkenamer rubber compositions; and a single-layered cover made in accordance with the present invention.
Figure 3:
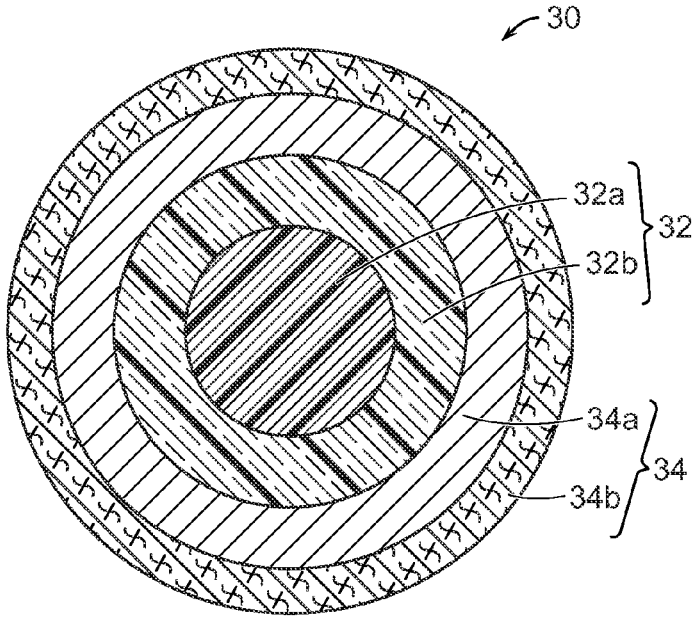
FIG. 3 is a cross-sectional view of a four-piece golf ball having a dual-core comprising inner core and outer core layers made of polyalkenamer rubber compositions; an inner cover layer; and an outer cover layer made in accordance with the present invention.
Figure 4:
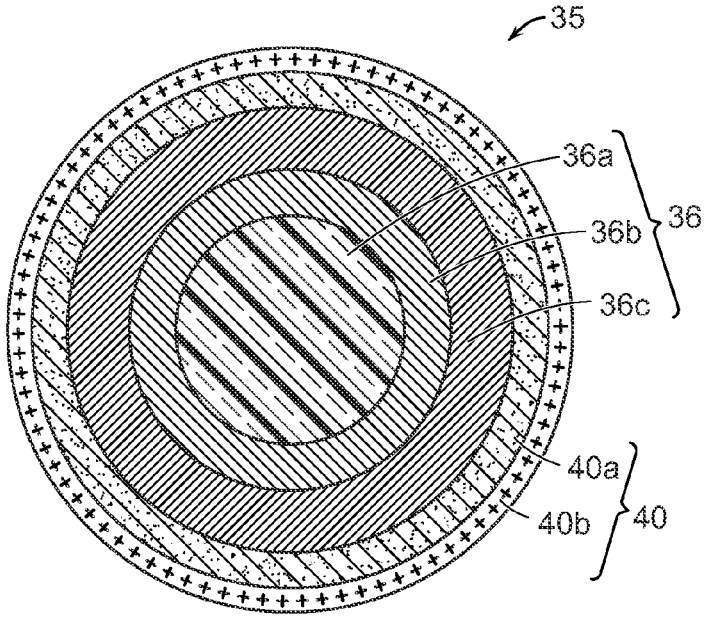
FIG. 4 is a cross-sectional view of a five-piece golf ball having a three-piece core comprising an inner core, an intermediate core layer, and outer core made of polyalkenamer rubber compositions; an inner cover layer; and an outer cover layer made in accordance with the present invention.

As discussed above, the polyalkenamer rubber materials of this invention may be used with any type of ball construction known in the art. Such golf ball designs include, for example, three-piece, four-piece, and five-piece designs. Referring to FIG. 1, one version of a golf ball that can be made in accordance with this invention is generally indicated at (20). Various patterns and geometric shapes of dimples (22) can be used to modify the aerodynamic properties of the golf ball (20). The dimples (22) can be arranged on the surface of the ball (10) using any suitable method known in the art. Referring to FIG. 2, a three-piece golf ball (24) having a dual-core (26) comprising an inner core (26*a*) and outer core layer (26*b*) made of polyalkenamer rubber compositions. The inner core (26*a*) is made of a low modulus composition and the outer core (26*b*) is made of a high modulus composition. The ball (24) further includes a polyurethane cover (28). In another embodiment, as shown in FIG. 3, a four-piece golf ball (30) contains a dual-core (32) comprising an inner core (32*a*) made of a low modulus polyalkenamer rubber composition and an outer core layer (32*b*) made of a high modulus polyalkenamer rubber composition. The golf ball (30) further includes a multi-layer cover (34) comprising inner cover (34*a*) and outer cover (34*b*) layers. Conventional thermoplastic or thermoset resins such as olefin-based ionomeric copolymers, polyamides, polyesters, polycarbonates, polyolefins, polyurethanes, and polyureas as described above can be used to make the inner and outer cover layers. Turning to FIG. 4 in yet another version, a five-piece golf ball (35) containing a three-piece core (36) comprising an inner core (36*a*); an intermediate core layer (36*b*); and outer core layer (36*c*) is shown. This ball includes a multi-layered cover (40) comprising an inner cover layer (40*a*) and outer cover layer (40*b*).

Test Methods

Hardness. The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within 0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180' apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

The outer surface hardness of a golf ball layer is measured on the actual outer surface of the layer and is obtained from the average of a number of measurements taken from opposing hemispheres, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface, care must be taken to ensure that the golf ball or golf ball subassembly is centered under the durometer indentor before a surface hardness reading is obtained. A calibrated, digital durometer, capable of reading to 0.1 hardness units is used for the hardness measurements. The digital durometer must be attached to, and its foot made parallel to, the base of an automatic stand. The weight on the durometer and attack rate conform to ASTM D-2240.

In certain embodiments, a point or plurality of points measured along the "positive" or "negative" gradients may be above or below a line fit through the gradient and its outermost and innermost hardness values. In an alternative preferred embodiment, the hardest point along a particular steep "positive" or "negative" gradient may be higher than the value at the innermost portion of the inner core (the geometric center) or outer core layer (the inner surface)—as long as the outermost point (i.e., the outer surface of the inner core) is greater than (for "positive") or lower than (for "negative") the innermost point (i.e., the geometric center of the inner core or the inner surface of the outer core layer), such that the "positive" and "negative" gradients remain intact.

As discussed above, the direction of the hardness gradient of a golf ball layer is defined by the difference in hardness measurements taken at the outer and inner surfaces of a particular layer. The center hardness of an inner core and hardness of the outer surface of an inner core in a single-core ball or outer core layer are readily determined according to the test procedures provided above. The outer surface of the inner core layer (or other optional intermediate core layers) in a dual-core ball are also readily determined according to the procedures given herein for measuring the outer surface hardness of a golf ball layer, if the measurement is made prior to surrounding the layer with an additional core layer. Once an additional core layer surrounds a layer of interest, the hardness of the inner and outer surfaces of any inner or intermediate layers can be difficult to determine. Therefore, for purposes of the present invention, when the hardness of the inner or outer surface of a core layer is needed after the inner layer has been surrounded with another core layer, the test procedure described above for measuring a point located 1 mm from an interface is used.

Also, it should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other. Shore C hardness was measured according to the test methods D-2240.

Moment of Inertia. Moment of Inertia (MOI) is measured on a model MOI-005-104 Moment of Inertia Instrument manufactured by Inertia Dynamics of Collinsville, Conn. The instrument is connected to a PC for communication via a COMM port and is driven by MOI Instrument Software Version #1.2

Compression. As disclosed in Jeff Dalton's Compression by Any Other Name, Science and Golf IV, Proceedings of the World Scientific Congress of Golf (Eric Thain ed., Routledge, 2002) ("J. Dalton"), several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the iii spring to deflect by more than 1.25 mm and therefore have a zero compression measurement. The Atti compression tester is designed to measure objects having a diameter of 42.7 mm (1.68 inches); thus, smaller objects, such as golf ball cores, must be shimmed to a total height of 42.7 mm to obtain an accurate reading. Conversion from Atti compression to Riehle (cores), Riehle (balls), 100 kg deflection, 130-10 kg deflection or effective modulus can be carried out according to the formulas given in J. Dalton.

Coefficient of Restitutuion ("COR"). The COR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. The COR is then calculates as the ratio of the ball's outgoing transit time period to the ball's incoming transit time period ($COR=V_{out}/V_{in}=T_{in}/T_{out}$).

EXAMPLES

The present invention is further illustrated by the following examples but these examples should not be construed as limiting the scope of the invention.

Example 1

In this Example, a dual-core comprising an inner core made from a low modulus composition and an outer core made from a high modulus composition was fabricated. A slug of polyalkenamer rubber composition having the formulation described in Table 1 was cured at about 350° F. for about 11 minutes to make an inner core material having a low modulus. A slug of polyalkenamer rubber composition having the formulation described in Table 2 was cured at about 350° F. for about 13 minutes to make an outer core material having a high modulus.

TABLE 1

| Inner Core Composition | Concentration (parts per hundred) |
|---|---|
| Vestenamer ® 8012—polyoctenamer rubber available from Degussa Corp. | 100 |
| Zinc diacrylate (ZDA) co-agent | 20 |
| Zinc oxide (ZnO) filler | 6 |
| Varox ® 231-XL—1,1-di(t-butylperoxy)-3,3,5-trimethylcyclohexane available from Atofina. | 2.5 |
| Zinc pentachlorothiophenol (ZnPCTP) | 1 |

TABLE 2

| Core Composition | Concentration (parts per hundred) |
|---|---|
| Vestenamer ® 8012—polyoctenamer rubber available from Degussa Corp. | 100 |
| Zinc diacrylate (ZDA) co-agent | 50 |
| Zinc oxide (ZnO) filler | 6 |
| Varox ® 231-XL—1,1-di(t-butylperoxy)-3,3,5-trimethylcyclohexane available from Atofina. | 2.5 |
| Zinc pentachlorotbiophenol (ZnPCTP) | 1 |

Concentrations are in parts per hundred (phr) unless otherwise indicated. As used herein, the term "parts per hundred," also known as "phr," is defined as the number of parts by weight of a particular component present in a mixture, relative to 100 parts by weight of the base rubber component. Mathematically, this can be expressed as the weight of an ingredient divided by the total weight of the polymer, multiplied by a factor of hundred.

Example 2

In this Example, slugs of different polyalkenamer rubber compositions having the formulations described in Table 2 were cured at different temperature/time cycles as described in Table 3 to make solid, single-layered core samples. Concentrations are in parts per hundred (phr) unless otherwise indicated. As used herein, the term "parts per hundred," also known as "phr," is defined as the number of parts by weight of a particular component present in a mixture, relative to 100 parts by weight of the base rubber component. Mathematically, this can be expressed as the weight of an ingredient divided by the total weight of the polymer, multiplied by a factor of 100.

TABLE 2

(Core Compositions Containing 100% Polyalkenamer as Base Rubber)

| Sample | Base Rubber | ZDA Co-agent (phr) | Peroxide Free-Radical Initiator (phr) | Zinc Oxide Filler (phr) | Soft and Fast Agent (phr) |
|---|---|---|---|---|---|
| A | Vestenamer* 8012 | 0 | 0 | 0 | 0 |

TABLE 2-continued (Core Compositions Containing 100% Polyalkenamer as Base Rubber)

| Sample | Base Rubber | ZDA Co-agent (phr) | Peroxide Free-Radical Initiator (phr) | Zinc Oxide Filler (phr) | Soft and Fast Agent (phr) |
|---|---|---|---|---|---|
| B | Vestenamer 8012 | 0 | 2.50 parts Varox* 231-XL | 0 | 0 |
| C | Vestenamer 8012 | 0 | 5.00 parts Varox 231-XL | 0 | 0 |
| D | Vestenamer 8012 | 33.5 parts SR-526* | 0.85 parts Perkadox* BC | 19.9 parts ZnO* | 0 |
| E | Vestenamer 8012 | 33.5 parts SR-526 | 1.75 parts Perkadox BC | 19.9 parts ZnO | 0 |
| F | Vestenamer 8012 | 33.5 parts SR-526 | 3.00 parts Perkadox BC | 19.9 parts ZnO | 0 |
| G | Vestenamer 8012 | 33.5 parts SR-526 | 5.00 parts Perkadox BC | 19.9 parts ZnO | 0 |
| H | Vestenamer 8012 | 33.5 parts SR-526 | 5.00 parts Perkadox BC | 19.9 parts ZnO | 1.0 parts ZnPCTP* |
| I | Vestenamer 8012 | 50 parts SR-526 | 1.00 parts Perkadox BC | 13.0 parts ZnO | 1.0 parts ZnPCTP |
| J | Vestenamer 8012 | 50 parts SR-526 | 1.00 parts Perkadox BC | 13.0 parts ZnO | 1.0 parts ZnPCTP |
| K | Vestenamer 8012 | 50 parts SR-526 | 2.00 parts Perkadox BC | 13.0 parts ZnO | 1.0 parts ZnPCTP |
| L | Vestenamer 8012 | 50 parts SR-526 | 2.00 parts Perkadox BC | 13.0 parts ZnO | 1.0 parts ZnPCTP |

TABLE 3

(Curing Cycle and Properties for Core Samples)

| Sample | Cure Temp (° F.) | Cure Time (Minutes) | DCM (Compression) | COR | Shore C Hardness |
|---|---|---|---|---|---|
| A | No Heat-Curing | No Heat-Curing | 102 | 0.568 | 75 |
| B | 350° F. | 12 Min. | 47 | 0.617 | 41 |
| C | 350° F. | 12 Min. | −62 | 0.687 | — |
| D | 350° F. | 11 Min. | 60 | 0.767 | 80.4 |
| E | 350° F. | 11 Min. | 68 | 0.778 | 82.9 |
| F | 350° F. | 11 Min. | 79 | — | 85.9 |
| G | 350° F. | 11 Min. | 75 | 0.780 | 87.6 |
| H | 350° F. | 11 Min. | 56 | 0.788 | 83.8 |
| I | 330° F. | 11 Min. | 91 | 0.794 | 85.9 |
| J | 350° F. | 11 Min. | 94 | 0.795 | 89 |
| K | 330° F. | 11 Min. | 98 | 0.792 | 90.7 |
| L | 350° F. | 11 Min. | 99 | 0.796 | 90.7 |

* Vestenamer ® 8012—polyoctenamer rubber having a trans-content of approximately 80% and a melting point of approximately 54° C., available from Evonik Degussa GmbH.
* SR-526—zinc diacrylate available from Akzo Nobel NV.
* Varox ® 231—XL-1,1-di(t-butylperoxy)-3,3,5-trimethylcyclohexane available from Atofina.
* Perkadox ® BC—dicumyl peroxide granules available from Akzo Nobel NV.
* ZnO—zinc oxide
* ZnPCTP—zinc pentachlorothiophenol, available from Strukol Company and Echina.

Example 3

In this Example, slugs of different polyalkenamer rubber compositions having the formulations described in Table 4 were cured at different temperature/time cycles as described in Table 5 to make solid, single-layered core samples.

TABLE 4

(Core Compositions Containing Blends of Polyalkenamer and Polybutadiene Rubber)

| Sample | Base Rubber | Secondary Rubber | ZDA Co-agent (phr) | Peroxide Free-Radical Initiator (phr) | Zinc Oxide Filler (phr) | Soft and Fast Agent (phr) |
|---|---|---|---|---|---|---|
| M | 80 parts Vestenamer 8012 | 20 parts Buna CB 23 | 40 parts SR-526 | 1 part Perkadox BC | 23.5 parts ZnO | 1 part ZnPCTP |
| N | 80 parts Vestenamer 8012 | 20 parts Buna CB 23 | 40 parts SR-526 | 1 part Perkadox BC | 23.5 parts ZnO | 1 part ZnPCTP |
| O | 80 parts Vestenamer 8012 | 20 parts Buna CB 23 | 40 parts SR-526 | 3 parts Perkadox BC | 23.5 parts ZnO | 1 part ZnPCTP |
| P | 80 parts Vestenamer 8012 | 20 parts Buna CB 23 | 40 parts SR-526 | 3 parts Perkadox BC | 23.5 parts ZnO | 1 part ZnPCTP |
| Q | 80 parts Vestenamer 8012 | 20 parts Buna CB 23 | 30 parts SR-526 | 1 part Perkadox BC | 26 parts ZnO | 2 parts ZnPCTP |
| R | 80 parts Vestenamer 8012 | 20 parts Buna CB 23 | 30 parts SR-526 | 1 part Perkadox BC | 26 parts ZnO | 2 parts ZnPCTP |
| S | 80 parts Vestenamer 8012 | 20 parts Buna CB 23 | 30 parts SR-526 | 2 parts Perkadox BC | 26 parts ZnO | 2 parts ZnPCTP |
| T | 80 parts Vestenamer 8012 | 20 parts Buna CB 23 | 30 parts SR-526 | 2 parts Perkadox BC | 26 parts ZnO | 2 parts ZnPCTP |

* Buna ® CB-23—polybutadiene rubber available from Lanxess Corp.

TABLE 5

(Curing Cycle and Properties for Core Samples)

| Sample | Cure Temp (° F.) | Cure Time (Minutes) | DCM (Compression) | COR | Shore C Hardness |
|---|---|---|---|---|---|
| M | 350° F. | 11 Min. | 89 | 0.789 | 51.4 |
| N | 330° F. | 11 Min. | 89 | 0.788 | 51.7 |
| O | 350° F. | 11 Min. | 99 | | 58.9 |
| P | 330° F. | 11 Min. | 96 | | 58.6 |
| Q | 350° F. | 11 Min. | 51 | 0.778 | 43.2 |
| R | 330° F. | 15 Min. | 54 | 0.780 | 44.5 |
| S | 350° F. | 11 Min. | 57 | 0.780 | 46.9 |
| T | 330° F. | 15 Min. | 59 | 0.780 | 48.6 |

In above Tables 2 and 3, the sample cores are made of rubber compositions containing 100% Vestenamer® 8012-polyoctenamer rubber (Samples A-L), while in Tables 4 and 5, the sample cores (M-T) are made of rubber compositions containing 80% Vestenamer 8012 and 20% Buna CB 23-polybutadiene rubber (Samples M-T).

In each of the samples, when the peroxide free-radical initiator is added to the rubber composition and heat and pressure are applied, a complex curing reaction occurs. In general, the resulting cross-linked core compositions have higher COR values. Cores with higher COR values have higher rebound velocities. These high COR cores (and golf balls made with such cores) generally rebound faster, retain more total energy when struck with a club, and have longer flight distance. The relatively high resiliency of the core means that it will reach a higher velocity when struck by a golf club and travel longer distances.

Surprisingly, however, the compression of the polyalkenamer rubber core composition in the above inventive samples does not increase substantially as the COR increases, as would be expected with conventional polybutadiene rubber cores. Rather, the compression of the polyalkenamer rubber core remains substantially the same or is reduced as the COR increases. While not wishing to be bound by any theory, it is believed the high crystallinity of the polyalkenamer rubber is reduced by adding the peroxide, particularly at relatively high amounts, as shown in Samples C and H (5 phr peroxide), and curing the composition so the rubber chains are cross-linked. This may cause the compression or stiffness of the polyalkenamer rubber composition to be reduced. Adding the peroxide at these high levels and curing and cross-linking the composition may disrupt the crystallinity of polyalkenamer. The material becomes softer and more rubbery, and the compression of the core sample is reduced. The compression of the core affects the "feel" of the ball as the club face makes impact with the ball. In general, cores with relatively low compression values have a softer feel. Golf balls made with such cores tend to have better playability and the sensation of hitting such balls is generally more pleasant. Furthermore, in general, when the ball contains a relatively soft core, the resulting spin rate of the ball is relatively low. The compressive force acting on the ball is less when the cover is compressed by the club face against a relatively soft core.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the objective stated above, it is appreciated that numerous modifications and other embodiments may be devised by those skilled in the art. Therefore, it will be understood that the appended claims are intended to cover all such modifications and embodiments, which would come within the spirit and scope of the present invention.

We claim:

1. A golf ball, comprising:

a) an inner core layer formed from a first rubber composition, the first rubber composition comprising polyalkenamer rubber in an amount of 80 weight percent and polybutadiene rubber in amount of 20 weight percent, and having a modulus of 1,000 to 50,000 psi;

b) an outer core formed from a second rubber composition, the second rubber composition comprising polyalkenamer rubber in an amount of about 50 to about 95 weight percent and polybutadiene rubber, the second rubber composition having a modulus of 72,000 to 150,000 psi; the modulus of the first rubber composition being at least 25% less than the modulus of the second rubber composition; and c) a cover.

2. The golf ball of claim 1, wherein the first rubber composition comprises peroxide in an amount of 2.5 phr or greater based on weight of the polyalkenamer rubber.

3. The golf ball of claim 1, wherein the core has an overall dual-core compression of 70 to 90.

4. The golf ball of claim 1, wherein the inner core has a surface hardness of 30 to 87 Shore C.

5. The golf ball of claim 1, Wherein the inner core has a surface hardness of 65 to 85 Shore C.

6. The golf ball of claim 1, wherein the outer core layer has a surface hardness of 80 to 97 Shore C.

7. The golf ball of claim 1, wherein the outer core layer has a surface hardness of 85 to 93 Shore C.

8. The golf ball of claim 1, wherein the core has an overall dual-core diameter of 1.52 to 1.59 inches.

9. The golf bail of claim 1, wherein the cover layer is formed from a composition selected from the group consisting of polyurethane; polyurea; or a hybrid, copolymer or blend of polyurethane and poly urea.

10. The golf ball of claim 1, wherein the cover comprises an inner cover layer and outer cover layer.

11. The golf ball of claim 10, wherein the hardness of the inner cover layer is greater than the hardness of the outer cover layer.

* * * * *